United States Patent [19]

Hosoda

[11] Patent Number: 4,878,666

[45] Date of Patent: Nov. 7, 1989

[54] GOLF CLUB

[76] Inventor: Rokuro Hosoda, 1-29-13, Akatsuka, Itabashi-ku, Tokyo, Japan

[21] Appl. No.: 252,172

[22] Filed: Sep. 30, 1988

[30] Foreign Application Priority Data

Oct. 9, 1987 [JP] Japan ..... 62-154086[U]

[51] Int. Cl.[4] ..... A63B 53/06

[52] U.S. Cl. ..... 273/79; 273/80.1; 273/168

[58] Field of Search ..... 273/80 C, 80.1, 167 G, 273/79, 168; 403/348, 359, 325, 315–319, 146, 97

[56] References Cited

U.S. PATENT DOCUMENTS

| | | | |
|---|---|---|---|
| 1,219,417 | 3/1917 | Vories | 273/79 |
| 3,214,169 | 10/1965 | Rupnow | 273/79 |
| 3,601,399 | 8/1971 | Agens | 273/79 |
| 3,791,647 | 2/1974 | Verderber | 273/79 |
| 3,840,231 | 10/1974 | Moore | 273/79 |

*Primary Examiner*—Edward M. Coven
*Assistant Examiner*—Sebastiano Passaniti
*Attorney, Agent, or Firm*—Frishauf, Holtz, Goodman & Woodward

[57] ABSTRACT

A golf club which is variable in its loft angle as an iron head to suit the mode of playing and which may be used as a putter by providing a putting face at the upper edge of the club head, comprises a spline shaft projecting from the lower end of the club shaft and inserted into a spline hole in a sleeve provided at the back of the club head. The club head can be retained at a desired angle as the spline shaft engages with the spline of the hole. At the tip end of the spline shaft projecting at the mouth of the sleeve, a bush with a lever is provided so that as the lever engages with the mouth of the sleeve, sliding of the spline shaft inside the sleeve is prevented. To change the angle of the club head, the lever located at the tip end of the spline shaft is turned to the position of a slit provided at the mouth of the sleeve, and as the lever slips into the slit, the spline shaft is caused to slide in the hole to release the spline engagement. By turning the club head so that the club face faces downward, the putting face provided at the upper edge of the club head becomes perpendicular and usable as a putter with the club face acting as the sole.

10 Claims, 3 Drawing Sheets

GOLF CLUB

BACKGROUND OF THE INVENTION

The present invention relates to a golf club, and more particularly to a golf club with multi-functions including putting which is characterized by the structure of an iron club head which is variable in its angle with respect to the club shaft and which is provided with a putting face at one portion thereof.

There is known a golf club wherein a club head is connected to a shaft in a freely rotatable manner as to permit arbitrary selection of attachment angles of the club head on the shaft, aiming to use a single club for multiple purposes.

Most of these known clubs which can be varied in the angle of the club head have the structure wherein a shaft is projected in an almost horizontal direction at the lower end of a club shaft, a club head is attached on the shaft in a manner to rotate around the same, and the club head is secured thereon at a given angle against the club shaft by tightening a nut engaged on the top of the shaft. Due to such structure, every time the angle of a face or a loft of a club head is changed to a desired degree in practice, it is necessary to loosen the nut, adjust the loft of the head to a desired angle, and to then tighten the nut securely at the angle. No matter to what extent the face angle of a club head can be varied, the need of loosening/tightening the nut so frequently presents a problem.

Moreover, in such a structure where the face angle of a club head is set by tightening a nut, if the nut is not sufficiently tightened, the club head tends to rotate as it hits a ball. The club of this structure hence does not always hit a ball accurately.

On the other hand, most of the conventional clubs with variable head angles have been proposed for use as an iron club and are made applicable as a long iron with a smaller inclination angle of the club face and as a short iron with a larger inclination angle. Thus, clubs of this type are theoretically usable as a putter on the putting green if the club head is rotated so that the club face stands perpendicularly, or in other words, to a state where there is no loft.

However, iron clubs are essentially intended to be used on the course at places other than the putting green, and the club face is not at a right angle with respect to the sole, as is the case of the putter. When used on the putting green, the club would damage the lawn as the edge formed by the face and the sole would cut into the ground, and for this reason, iron clubs are not allowed on the putting green. Even if the attachment angle of the club head as against the shaft is made variable for multipurpose use, the use will be limited to the golf course areas other than the putting green, and the inconvenience of carrying a separate putter still remains.

SUMMARY OF THE INVENTION

The primary object of the present invention is to provide a club head structure comprising a spline shaft which projects laterally from the lower end of the club shaft and which is to be inserted in a sleeve provided at the back of the head, and a bush which is rotatable by means of a lever that abuts against the mouth of said sleeve, whereby, instead of clamping the head to the club shaft by means of a screw which tends to result in incomplete engagement, the club head is easily adjusted to and retained at a desired angle by simply rotating the lever with the tip of the fingers.

The club head according to the present invention is provided at its back with a sleeve having a hole in the longitudinal direction and this sleeve receives a horizontal spline shaft projecting from the lower end of the club shaft. The club head and the club shaft are fixedly engaged at a predetermined angle as the spline shaft engages with a spline hole. A bush with a stubbed lever on its outer periphery that can be easily picked up with the fingers is arranged at the tip of the spline shaft inserted in the spline hole. When the spline shaft is in engagement with the spline hole as mentioned above, the lever abuts against the mouth of the sleeve and prevents movement of the spline shaft within the hole, securing the engagement of the club head at a desired angle.

To change the angle of attachment of the club head, one turns the lever abutting against the mouth of the sleeve at the tip of the spline shaft to the position of a longitudinal slit provided at the mouth of the sleeve where the lever may be allowed to slip into the slit. By sliding the spline shaft along the spline hole while holding the club head and the club shaft with both hands in this position, the spline engagement is released and the club head may be rotated to a desired angle with respect to the club shaft. As the club head is fixed at the desired angle, the spline shaft is returned to a position where it engages with the spline hole for engagement, thereby fixing the club head angle. Upon the spline engagement, the lever is pushed out of the slit. By turning the lever so as to be released from the slit and to abut against the mouth of the sleeve, sliding of the spline shaft in the hole is prevented, securing the club head at the selected angle. The face of the club head according to the present invention can be set at desired angles by simply turning the lever at the end of the bush and by sliding the spline shaft in the spline hole with said lever being inserted in the slit provided on the sleeve.

Another object of the invention is to enable the club head to be used as a putter by forming a putting face at the upper edge of the face, said putting face being a relatively thin plate which is cast integrally with the club head, and bent at right angle from the face toward the back of the club head. By manipulating the club head as mentioned above so that the club face becomes horizontal with respect to the ground, the club head can be used as a putter.

As mentioned above, the spline hole provided at the back of the club head and the spline shaft projecting from the club shaft are both freely rotatable over 360° when these members are out of spline engagement with each other. By sliding the spline shaft in the sleeve to release the engagement and by setting the club face at such an angle that the club face faces the putting green horizontally in a completely downward direction, said putting face provided at the upper face edge becomes perpendicular to the putting green and thus can hit the ball as a putter. The club head according to the present invention is advantageous in that when used as a putter the club face which is flat and large in area touches the lawn instead of the narrow sole as in the case of the conventional clubs of this type, eliminating the danger of damaging the lawn.

BRIEF DESCRIPTION OF THE DRAWINGS

Other objects and advantages of this invention will become apparent when taken in conjunction with description hereinbelow of an embodiment shown in the accompanying drawings.

DETAILED DESCRIPTION OF PREFERRED EMBODIMENT

Figure 1:
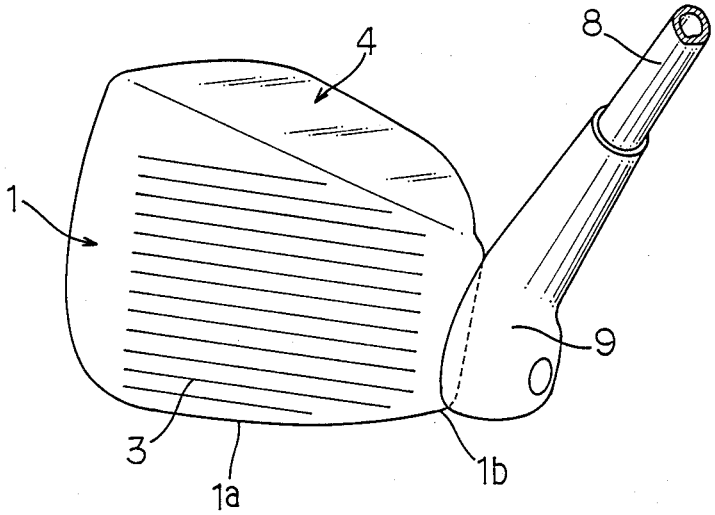
FIG. 1 is a front perspective view of the club head of the golf club according to the present invention.
Figure 2:
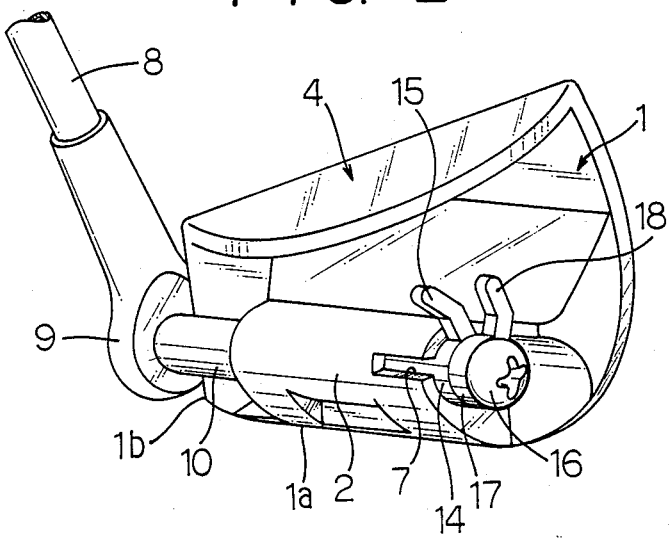
FIG. 2 is a perspective view of the club head in FIG. 1 as viewed from the back.

As shown in FIG. 2, the golf club according to the present invention comprises a shaft 8, a spline shaft 10 projecting laterally from the lower end 9 of the shaft 8, and a club head 1 which is rotatably journalled to the shaft by means of said spline shaft 10. The club head 1 is provided with a sleeve 2 which bulges along the longitudinal direction of a sole 1*a* at the back of the head. The spline shaft 10 of the club shaft 8 is inserted in a spline hole 2*a* of the sleeve 2. A putting face 4 is a relatively thin plate which is cast integrally with the club head, and projects from the upper edge of the club head, 1 toward its back and has a plane normal to the club face.

Figure 3:
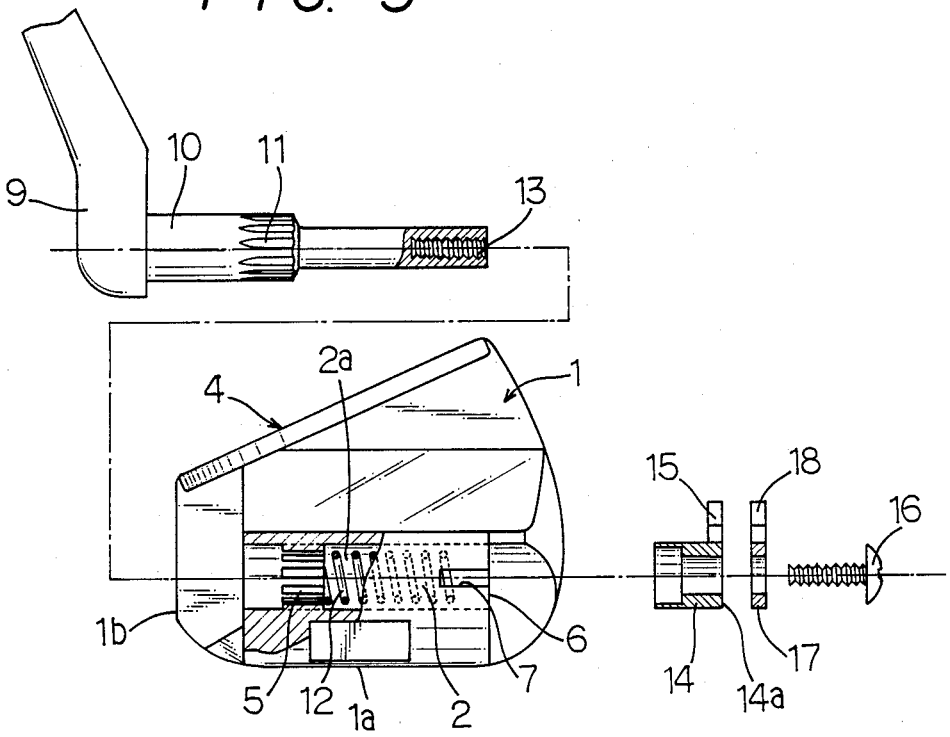
FIG. 3 is a rear view to show the component parts of the club head and the club shaft.

As shown in FIG. 3, a mouth 6 of the sleeve 2 provided at the back of the club head 1 is located inside the tip end of the club head 1. Plural spline grooves 5 are provided along the longitudinal direction of the sleeve inside the spline hole 2*a* on the side of a heel 16. One portion of the mouth 6 of the sleeve 2, preferably on the back of the sleeve 2 which is parallel to the back of the club head 1, is provided with a slit 7 in the longitudinal direction of the sleeve 2.

The spline shaft 10 projecting from the club shaft 8 is substantially longer than said sleeve 2. Outer teeth 11 which engage with the spline grooves in the sleeve 2 are provided longitudinally on the outer periphery of the shaft 10 near the lower end 9 of the club shaft 8. Thus, when the outer teeth 11 are engaged with the spline grooves 5 of the sleeve 2, a spline engagement 20 is achieved. The tip end of the spline shaft 10 is made thinner than the outer diameter of the outer teeth 11 and is bored with a cylindrical form, the inner periphery thereof being provided with a female screw 13. Further, a bush 14 is attached to the outer periphery of the spline shaft 10 at its tip end. The bush 14 fits in the spline hole 2*a* of the sleeve 2.

Figure 4:
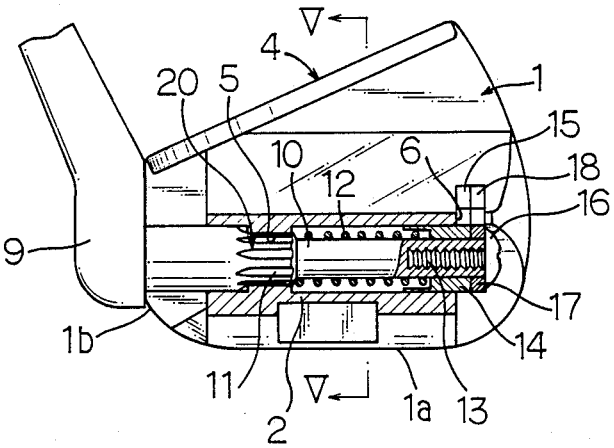
FIG. 4 is a partially exploded rear view to show the assembly of the component parts in FIG. 3.

As shown in FIG. 4, as the spline shaft 10 is inserted in the sleeve 2 for its entire length, the outer teeth 11 engage with the spline grooves 5 to form the spline engagement 20, whereby the club head 1 is set at a predetermined angle with respect to the club shaft and the club face 3 is given a desired loft. In this arrangement, a coil spring 12 is inserted inside the sleeve 2 from the mouth 6 of the sleeve 2. Upon insertion of the spring 12 in the sleeve 2, said bush 14 is fitted, pressing against the coil spring 12, on the outer periphery of the spline shaft at the tip. The bush 14 is provided at the outer periphery of its outer end 14*a* with a stubbed lever 15 that can be slipped into said slit 7 of the sleeve 2 by picking the lever with the finger tips. After the bush 14 with the lever 15 is fitted to the tip of the spline shaft 10, a bolt 16 is mated with the female screw 13 at the tip end of the shaft 10 to secure the bush 14 on the tip end of the shaft 10. In this way, the lever 15 acts as a stopper for the mouth 6 of the sleeve 2 to prevent the spline shaft 10 from slipping out of the sleeve 2.

Figure 6:
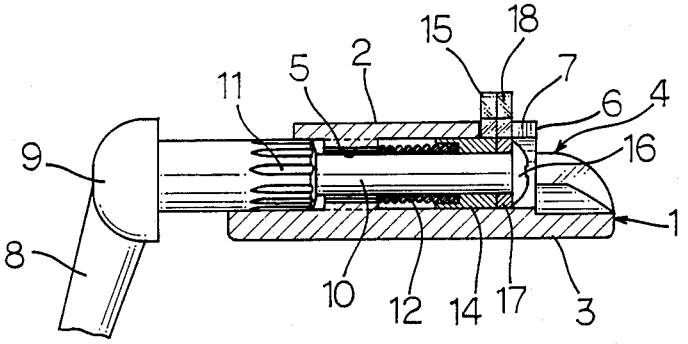
FIG. 6 is a sectional view along the line VI—VI in FIG. 5 to show the relation of the spline shaft and the club head when the angle of the club head is to be varied.
Figure 5:
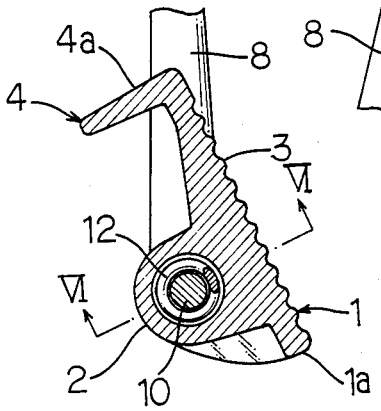
FIG. 5 is a sectional view of FIG. 4 along the line V—V.
Figure 7:
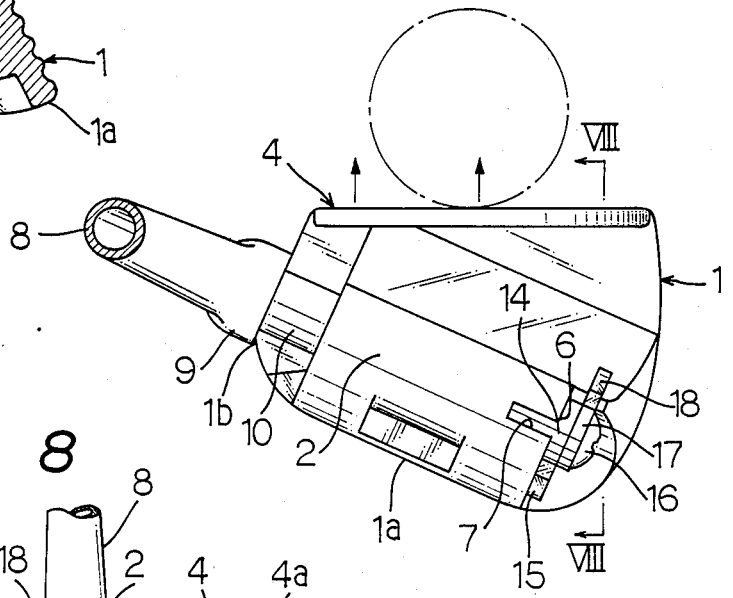
FIG. 7 is a plan view of the club head when used as a putter.

When the bush 14 is attached to the tip of the spline shaft 10 as mentioned above, the shaft 10 is retained in the sleeve by the engagement of the lever 15 with the mouth 6 of the sleeve 2. However, because the bush 14 is rotatably fitted inside the spline hole 2*a* of the sleeve 2, the lever 15 can move to a position where it may slip into the slit 7 as the bush is rotated by the impact of the club face 3 hitting a ball. As the lever 15 moves to the position of the slit 7, the spline shaft 10 may at any time be slid in the spline hole 2*a*, allowing the club head 1 to rotate freely around the spline shaft 10. In reality, however, as the spring 12 inserted in the spline hole 2*a* presses the bush 14 toward the mouth 6 of the sleeve, the club head 1 will not rotate about the shaft 10 unless the spline engagement 20 is released by forcing the club head along the spline shaft 10 as if to pull it out, as shown in FIG. 6. It is noted that depending on the condition, the impact of the club face hitting the ball may force the club head to be pulled out of the spline shaft 10. If the lever 15 happens to be at the position of the slit 7, the club head 1 slides out of the shaft 10, releasing the spline engagement 20 whereby the club head 1 can no longer maintain its predetermined angle. This is of course hazardous. In order to prevent this, it is desirable to provide a ring 17 having another lever 18 similar to the lever 15 of the bush 14, in a freely rotatable manner with respect to the spline shaft 10, by means of a bolt 16 with its head. Even if the lever 15 slips into the slit 7 to cause the club head 1 to slide out of the spline shaft 10 due to the disengagement of the spline 20, the lever 18 is in firm engagement with the mouth 6 of the sleeve 2, preventing the above mentioned hazard.

Figure 8:
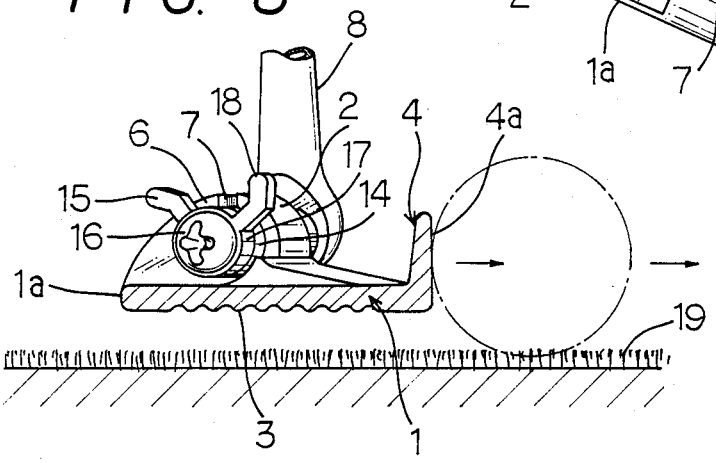
FIG. 8 is a sectional view along the line VIII—VIII in FIG. 7.

To change the loft angle of the club head 1, the levers 15 and 18 abutting against the mouth 6 of the sleeve 2 are turned with the finger tips to the position of the slit 7 to allow them to slip into the slit. At this position, the club head 1 is pulled out of the spline shaft 10 against the resilience of the spring 12 in the sleeve 2 by holding the club shaft 8 and the club head with both hands. As the engagement 20 of the shaft 10 and the spline hole 2*a* is released, the club head 1 becomes freely rotatable with respect to the spline shaft 10, enabling the loft of the club face 3 to be adjusted to a desired angle. As the loft angle of the club face 3 is set, the spline shaft 10 is pushed back into the sleeve 2 utilizing the resilience of the spring 12 for the spline engagement 20 to thereby fix the club head 1 at the desired angle. As the spline shaft 10 resumes its predetermined position within the spline hole 2*a*, the levers 15 and 18 at the tip of the shaft 10 are pushed out of the slit 7. The levers are then turned to abut against the mouth 6 of the sleeve 2. Instead of arranging the levers 15 and 18 at the same position as shown in FIG. 4, they are turned separately in opposite directions off the position of the slit 7, as shown in FIG. 8. With this arrangement, sliding of the spline shaft 10 can be prevented and safety in use is secured even if either one of the levers slips into the slit 7 as the other lever remains abutted against the mouth 6 of the sleeve 2.

To use the club head 1 as a putter, the attachment angle of the club head 1 with respect to the spline shaft 10 is made variable by the manipulations mentioned above, and then the club head 1 is turned so that the face 3 is directed downward opposing the surface of the lawn 19, at which position the angle is fixed. In this state, the putting face 4 provided at the upper edge of the club head 1 can be used as a putter with the club face 3 acting as the sole.

As has been described above, the golf club according to the present invention is capable of freely rotating its iron head over 360°. This enables multi-purpose use of the club face 3 of the head 1 as a long iron, middle iron, short iron and wedge. Moreover, it requires only simple manipulations of the levers 15 and 18 provided at the tip of the spline shaft 10 in order to change and maintain the angle of the club head 1. The golf club according to the present invention is, therefore, advantageous in ease of handling and in safety as compared with the conventional clubs of this type which are clamped by means of screws. As the putting face 4 is provided at the upper edge of the club head 1, the golf club can be used as a putter with the wide and flat club face acting as the sole, avoiding the danger of damaging the lawn. This expands the range of use of the clubs of this type.

What is claimed is:

1. An adjustable golf club having a handle, shaft, and a club head assembly, comprising:

a spline shaft projecting from the lower end of the club shaft;

a sleeve provided at the back of said club head for permitting insertion of said spline shaft, said sleeve including a mouth end;

said spline shaft connected to a spline hole in said sleeve by spline engagement means such that the angle of the club head with respect to the club shaft may be selectively adjusted;

said club head including a club face having at its upper edge a putting surface located in a plane substantially normal to said club face and facing generally the back of the club head;

a slit provided longitudinally along said sleeve at the back of said club head located proximate said mouth end of said sleeve;

said spline shaft further including a tip end projecting from said mouth end engaged with a bush having an inner and outer end, wherein said bush is rotatably mounted about the outer periphery of said spline shaft;

a coil spring inserted in said spline hole of said sleeve between said spline engagement means and said inner end of said bush;

said outer end of said bush attached to said tip end of said spline shaft by means of a bolt head which screws into said tip end of said spline shaft; and said bush further including a lever abutting against said mouth end of said sleeve to prevent accidental disengagement of said spline engagement means.

2. The golf club of claim 1, wherein said putting surface of said club head is made of a thin plate which is cast integrally with said club head and which is substantially normal to said club face substantially over the entire length of said upper edge of said club face.

3. The golf club of claim 2, wherein said sleeve is provided along the length of the back of said club head at a lower portion of said club head.

4. The golf club of claim 1, wherein said sleeve is provided along the length of the back of said club head at a lower portion of said club head.

5. The golf club of claim 4, wherein said mouth end of said sleeve is located on the backside of and inside a tip end of said club head.

6. The golf club of claim 3, wherein said mouth end of said sleeve is located on the backside of and inside a tip end of said club head.

7. The golf club of claim 2, wherein said mouth end of said sleeve is located on the backside of and inside a tip end of said club head.

8. The golf club of claim 1, wherein said mouth end of said sleeve is located on the backside of and inside a tip end of said club head.

9. The golf club of claim 1 wherein said slit is provided substantially in parallel with said back of said club head.

10. The golf club of claim 1, wherein said bolt is screwed to said tip end of said spline shaft by means of a female screw provided inside said tip end of said spline shaft.

* * * * *